US011507023B2

(12) United States Patent
Favre et al.

(10) Patent No.: US 11,507,023 B2
(45) Date of Patent: Nov. 22, 2022

(54) ARRANGEMENT FOR THE HOLDING AND VIBRATION TRANSMISSION OF AN ACOUSTIC RADIATING MEMBRANE IN A WATCH CASE

(71) Applicant: The Swatch Group Research and Development Ltd, Marin (CH)

(72) Inventors: Jérôme Favre, Neuchâtel (CH); Nicolas Livat, Cressier (CH)

(73) Assignee: The Swatch Group Research and Development Ltd, Marin (CH)

( * ) Notice: Subject to any disclaimer, the term of this patent is extended or adjusted under 35 U.S.C. 154(b) by 143 days.

(21) Appl. No.: 17/071,101

(22) Filed: Oct. 15, 2020

(65) Prior Publication Data

US 2021/0181684 A1 Jun. 17, 2021

(30) Foreign Application Priority Data

Dec. 11, 2019 (EP) ..... 19215149

(51) Int. Cl.

| | |
|---|---|
| ***G04B 37/00*** | (2006.01) |
| ***G04B 21/06*** | (2006.01) |
| ***G04B 21/08*** | (2006.01) |

(52) U.S. Cl.

CPC ..... *G04B 37/0075* (2013.01); *G04B 21/06* (2013.01); *G04B 21/08* (2013.01)

(58) Field of Classification Search

CPC .. G04B 37/0075; G04B 23/028; G04B 21/12; G04B 21/08; G04B 23/12; G04B 21/06; G04B 37/11; G04B 37/08

See application file for complete search history.

(56) References Cited

U.S. PATENT DOCUMENTS

| | | | | |
|---|---|---|---|---|
| 2,786,326 A | 3/1957 | Junghans et al. | | |
| 7,995,776 B2 * | 8/2011 | Greubel | G04B 37/0075 | 381/334 |

(Continued)

FOREIGN PATENT DOCUMENTS

| | | |
|---|---|---|
| CH | 289 432 A | 3/1953 |
| CH | 311 296 A | 11/1955 |

(Continued)

OTHER PUBLICATIONS

Notice of the Reason for Refusal dated Oct. 19, 2021 from the Japanese Patent Office in Japanese English Application No. 2020-175103.

(Continued)

*Primary Examiner* — Edwin A. Leon

(74) *Attorney, Agent, or Firm* — Sughrue Mion, PLLC

(57) ABSTRACT

An arrangement for the holding and vibration transmission of an acoustic radiating membrane (10) in a striking or musical watch (1) case (2). The case includes at least one crystal (3) mounted on a middle (4) and a back (5) mounted on a side opposite the middle. The acoustic radiating membrane is held in a portion of the watch case, such as the middle by at least one connection part (12) disposed between a peripheral rim of the membrane or an edge element (11) of the membrane and the middle by acting for the holding of the membrane in a direction parallel to the plane of the watch. The connection part may be a screw screwed into a threaded opening (14) of the middle and coming into contact with the edge element of the membrane.

13 Claims, 4 Drawing Sheets

(56) References Cited

U.S. PATENT DOCUMENTS

| | | | | |
|---|---|---|---|---|
| 8,770,833 | B2 * | 7/2014 | Sciascia | G04B 21/08 368/315 |
| 9,164,487 | B1 * | 10/2015 | Raggi | G04B 21/08 |
| 2007/0140067 | A1 | 6/2007 | Greubel et al. | |

FOREIGN PATENT DOCUMENTS

| | | | | |
|---|---|---|---|---|
| CH | 714635 | A1 * | 8/2019 | G04B 21/08 |
| DE | 873 825 | C | 4/1953 | |
| GB | 2066525 | A * | 7/1981 | G04B 37/0008 |
| JP | 8-334574 | A | 12/1996 | |

OTHER PUBLICATIONS

European Search Report for EP 19 21 5149 dated May 8, 2020.

* cited by examiner

ARRANGEMENT FOR THE HOLDING AND VIBRATION TRANSMISSION OF AN ACOUSTIC RADIATING MEMBRANE IN A WATCH CASE

CROSS-REFERENCE TO RELATED APPLICATIONS

This application claims priority to European Patent Application No. 19215149.6 filed Dec. 11, 2019, the entire contents of which are incorporated herein by reference.

TECHNICAL FIELD OF THE INVENTION

The invention relates to an arrangement for the holding and vibration transmission of an acoustic radiating membrane in a musical or striking watch case.

The invention also relates to a musical or striking watch comprising an arrangement for the holding and vibration transmission of an acoustic radiating membrane in a watch case.

PRIOR ART

In a traditional striking mechanism of a watch, one or more gongs, which are fastened to at least one gong carrier, are struck by one or more hammers in a same horizontal plane as the plate supporting the horological movement. A membrane of the striking mechanism is also added in the case for an acoustic radiation of the vibration of the gong or gongs struck. The membrane is generally clamped in a direction perpendicular or vertical to the plane between a support of the movement and a portion of the middle for the holding thereof in the watch case. In one particular example, the membrane is disposed between the back of the watch case and the movement on the watch plate. It is fastened or clamped between the back and a portion of the middle of the watch case. However, it is noted that there is not a good vibratory transfer of a struck gong towards the membrane for a suitable acoustic radiation of the sound generated.

In the case of a musical watch, the sound is produced by the vibrations of blades of a pin-barrel of the striking mechanism and an acoustic radiating membrane may also be provided in the watch case. Said membrane is clamped in a direction perpendicular to the plane between a support of the movement and a portion of the middle for the holding thereof in the watch case.

Patent EP 2 367 078 B1 describes a watch provided with a striking mechanism. An acoustic membrane is disposed and connected to the case of the watch in order to emit a sound produced by the striking mechanism. The membrane is held in the case of the watch by being clamped between a support of the movement and the back of the case in a direction perpendicular to the watch plane. With such a holding of the membrane, this does not make it possible to have a good vibratory transfer of a sound generated towards the membrane for a suitable acoustic radiation.

SUMMARY OF THE INVENTION

Therefore, the aim of the invention is to overcome the drawbacks of the prior art by providing an arrangement for the holding and vibration transmission of an acoustic radiating membrane in a striking, or even musical, watch case, in order to obtain a good acoustic performance during the operation of a striking mechanism in the watch case.

To this end, the invention relates to an arrangement for the holding and vibration transmission of an acoustic radiating membrane in a watch case comprising the features defines in the independent claim 1.

Particular embodiments of the arrangement for the holding and vibration transmission of an acoustic radiating membrane are defined in the dependent claims 2 to 11.

One advantage of the arrangement of the acoustic radiating membrane according to the present invention, resides in the fact that a holding of the acoustic radiating membrane in the watch case is obtained by at least one connection part acting in a horizontal and non-vertical direction on a rim of the membrane or on an edge element of the membrane. The connection part may be a coil spring bearing on a gong carrier for example between an inner wall of the middle and a rim or an edge element of the membrane. The connection part may also be a screw, which is screwed into a threaded opening for example of the middle in order to laterally bear on the rim or a membrane edge element, or a combination of a screw and of a coil spring.

Advantageously, according to a first embodiment and in comparison with a coil spring, the use of a screw makes it possible to significantly increase the force of connection or of contact of the membrane in relation to a spring, but also to control same. Bearing on the periphery of the membrane, a compression effect of the membrane is produced. It may also be envisaged to adapt a frequency of acoustic radiation of the membrane in tune with a struck gong generating a particular note or with at least one activated blade of a musical pin-barrel. Thus, this makes it possible to adapt the main frequency of acoustic radiation of the membrane by the holding force applied to said membrane so as to adapt same more easily to a gong more difficult to tune and generating a particular note once struck.

Advantageously, according to another embodiment, at least two screws are provided each passing into a different and through opening of a peripheral edge of the membrane in order to each be screwed into a respective threading produced in a wall of the watch case, for example the middle. This makes it possible to significantly increase the stretching force of the membrane during the holding thereof in order to adapt the main frequency of acoustic radiation of the membrane in tune with a struck gong generating a particular note or with at least one activated blade of a musical pin-barrel. According to this other embodiment, the adaptation of frequency is the reverse of that of the first aforementioned embodiment.

To this end, the invention also relates to a striking or musical watch with an acoustic radiating membrane arrangement in a watch case, and which comprises the features defined in the independent claim 12.

An embodiment of the striking or musical watch is defined in the dependent claim 13.

Advantageously, a plurality of acoustic membranes may be provided. A first membrane at the dial and a second membrane as double back above the back of the watch case may be provided. It may also be provided to mount a plurality of acoustic membranes spaced apart from one another or superimposed. All of the membranes are held in a portion of the watch case by a connection part in contact with a peripheral rim or with an edge element of each membrane with a support or acting in a direction parallel to the plane of the watch, that is to say parallel to a watch dial or of a plate supporting the watch movement.

BRIEF DESCRIPTION OF THE FIGURES

The aims, advantages and features of the arrangement for the holding and vibration transmission of the acoustic radiating membrane in the watch case will become clear in the following description based on non-limiting embodiments illustrated by the drawings wherein.

DETAILED DESCRIPTION OF THE INVENTION

In the following description, all the portions in relation to the holding of an acoustic radiating membrane in a watch case, which are well known by the person skilled in the art in this technical field, are only described in a simplified manner.

Figure 1A:
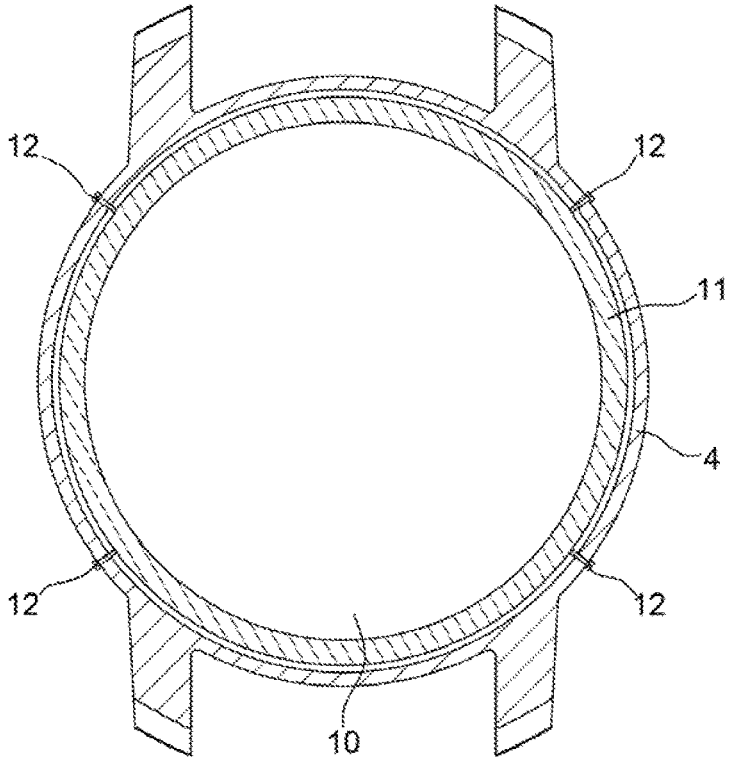
FIGS. 1*a* and 1*b* show in a simplified manner a top view of a first embodiment of an arrangement for the holding and vibration transmission of an acoustic radiating membrane, and a partial cross-section of a first embodiment of the arrangement for the holding and vibration transmission of an acoustic radiating membrane in a watch case according to the invention.
Figure 1B:
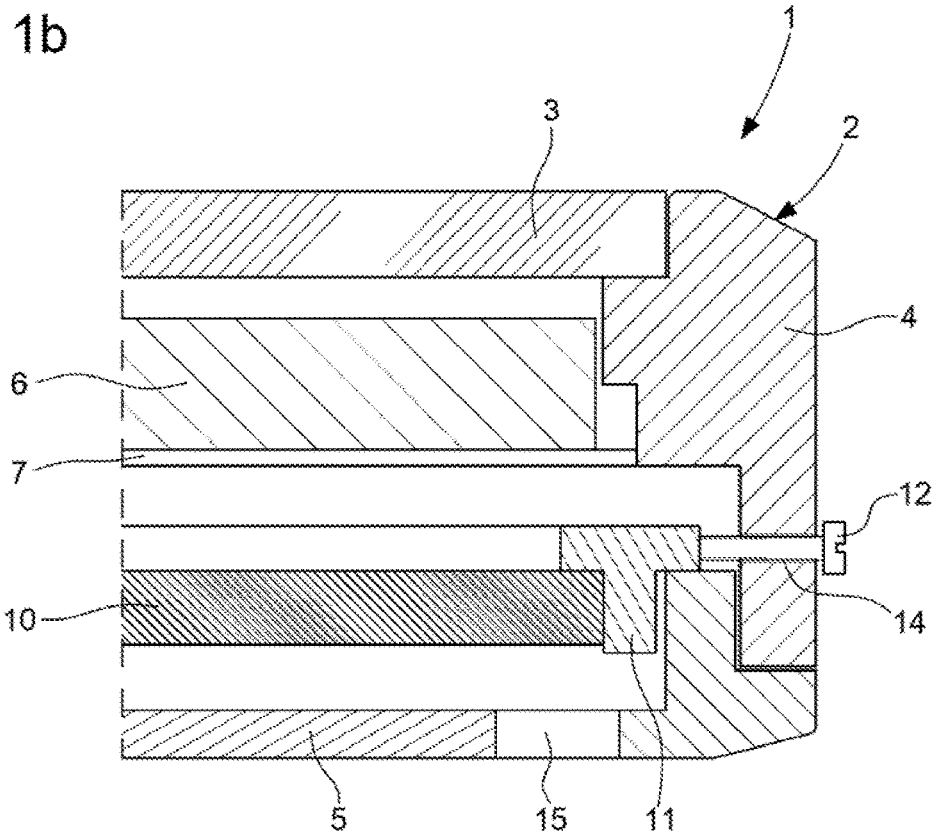

FIGS. 1*a* and 1*b* show a simplified top view without horological movement 6 and support 7 of the horological movement, and a simplified partial cross-section of a first embodiment of a watch case 2 comprising an arrangement for the holding and vibration transmission of at least one acoustic radiating membrane 10 in the watch case 2. The acoustic radiating membrane 10 of the holding arrangement is held in the watch case 2 by at least one connection part 12 acting in a horizontal direction parallel to a watch plane on an rim of the membrane 10 or on an edge element 11 of the membrane 10.

In this first embodiment, the connection part is at least one screw 12 screwed through a threaded opening 14 of a portion of watch case 2, for example of a watch case 2 middle 4. The inner end of the screw 12 comes to bear against a peripheral rim of the membrane 10 or against an outer portion of the edge element 11 fastened on the periphery of the membrane 10 as shown in FIGS. 1*a* and 1*b*. The screw 12 preferably bearing against the cylindrical surface of the rim of the membrane or of the edge element 11. The screw 12 must have a length longer than the threaded opening 14 and preferably of a length one and half times the length of the threaded opening 14 to make it possible to hold the membrane in the watch case 2, and a determined compression force for the adjustment of a frequency of radiation.

If a single screw 12 is provided for holding the membrane 10 in the watch case 2, the peripheral rim of the membrane 10 or of the edge element 11 of the membrane 10, shown in FIGS. 1*a* and 1*b*, comes to bear against a cylinder-shaped inner surface for example of the middle 4 once the screw 12 comes to bear on the opposite side against the rim or the edge element 11 of the membrane 10. The more the screw 12 is screwed into the threaded opening 14 of the middle 4 and the more the membrane 10 is compressed, which has the effect of modifying the frequency of acoustic radiation thereof. Thus, said frequency can be adjusted in tune for example with the note generated by a gong struck by a hammer of a striking mechanism in the horological movement 6. According to the present invention, the arrangement for holding the membrane 10 in the watch 1 case 2 is performed in the plane parallel to the dial or support 7 of the horological movement 6 by means of at least one connection part, such as a screw 12 screwed into a threaded opening 14 in the middle 4 for example.

As shown in FIG. 1*b*, the watch 1 essentially comprises a watch case 2, which consists of a middle 4, whereon at least one crystal 3 is fastened in a sealed manner from an upper side, and a back 5 fastened from another lower side of the middle 4. The back 5 is mounted by known means not shown and in a removable and sealed manner on the middle 4. The back 5 may also comprise openings 15 evenly distributed around a coaxial circle inside the rim of the back 5. Said openings 15 make it possible for the notes generated or the melody generated in the watch case and radiated by the acoustic membrane 10 to be transmitted outside of the watch case 2.

The watch 1 also comprises a horological movement 6 or a horological electronic module 6 disposed on a support 7, such as a plate. A striking mechanism in the horological movement 6 may comprise in a first variant at least one gong mounted on a gong carrier fastened on a plate 7 or to the middle 4, and at least one hammer mounted rotatably or with linear movement on the plate in order to strike said gong in determined periods. The striking mechanism may comprise in a second variant a pin-barrel with an assembly of blades connected to a heel, which is fastened on the plate, and pins integral with a cylinder or with a disk in rotation on the plate in order to activate the blades for the generation of a melody.

The watch 1 also comprises a dial not shown and above the horological movement 6, which is held in the edge on or against the middle 4 and disposed below the watch crystal 3. In the case of a mechanical striking or musical watch 1, hands for indicating the time, which are not shown, are provided on the dial that generally supports the time indexes on the periphery.

In the remainder of the description, reference will mainly be made to a striking mechanism with at least one gong fastened to a gong carrier mounted on a plate or in connection with the middle 4 of the watch case 2 and likely to be struck by a hammer for the generation of a particular note.

The mechanical or electronic striking or musical watch 1 essentially comprises at least one acoustic membrane 10 to improve the acoustic performance of the sound produced by the striking mechanism. In addition to the clearly determined geometric shape, the acoustic membrane 10 may be produced in a material chosen to control and optimise the density of modes in the range of audible frequencies. Generally, the material chosen may be steel, or amorphous metal, or a polymer, or in another metal material. Preferably, the material chosen may also be for example made of wood or made of composite material, which may be a wood composite, but without any limitation.

The thickness of the membrane 10 may be close to 1 mm in said scenario. According to one alternative embodiment shown in FIGS. 1*a* and 1*b*, an edge element 11 of angular shape may be fastened to the peripheral rim of the membrane 10. The diameter of the membrane 10 with the edge element 11 thereof may be similar to the diameter of the watch crystal 3, and may be between 20 and 40 mm. The metal edge element 11 or made of amorphous metal, in cross-section has a T shape with an annular inner side fastened on the periphery of the rim of the membrane 10 and with an annular outer side coming to bear on an inner portion of the back 5 fastened to the middle 4. Said annular outer side comprises for example a cylindrical surface for the bearing of each screw 12 for holding the membrane 10.

As indicated previously, at least one screw 12 is provided, but there may be a plurality of other screws 12 normally regularly distributed around the membrane 10 or the edge element 11. Said various screws 12 are arranged to each come into contact with a peripheral rim of the membrane 10 or as shown in FIGS. 1*a* and 1*b* with the edge element 11 once each screwed into a respective threaded opening 14 in the middle 4. At least two screws 12 at 180° from one another or three screws 12 at 120° from one another or four screws 12 at 90° from one another as shown in FIGS. 1*a* and 1*b*, or even more screws 12. Said four screws 12 are each screwed into the corresponding threaded opening 14 thereof in the middle 4 to come into contact with the edge element 11. Depending on the contact force of each screw 12 against the outer portion of the edge element 11 following the screwing operation, an adaptation of frequency of radiation of the membrane 10 is obtained more easily than with a single screw 12 in order to adapt to the frequency of vibration of at least one gong once struck by the hammer.

Figure 5:
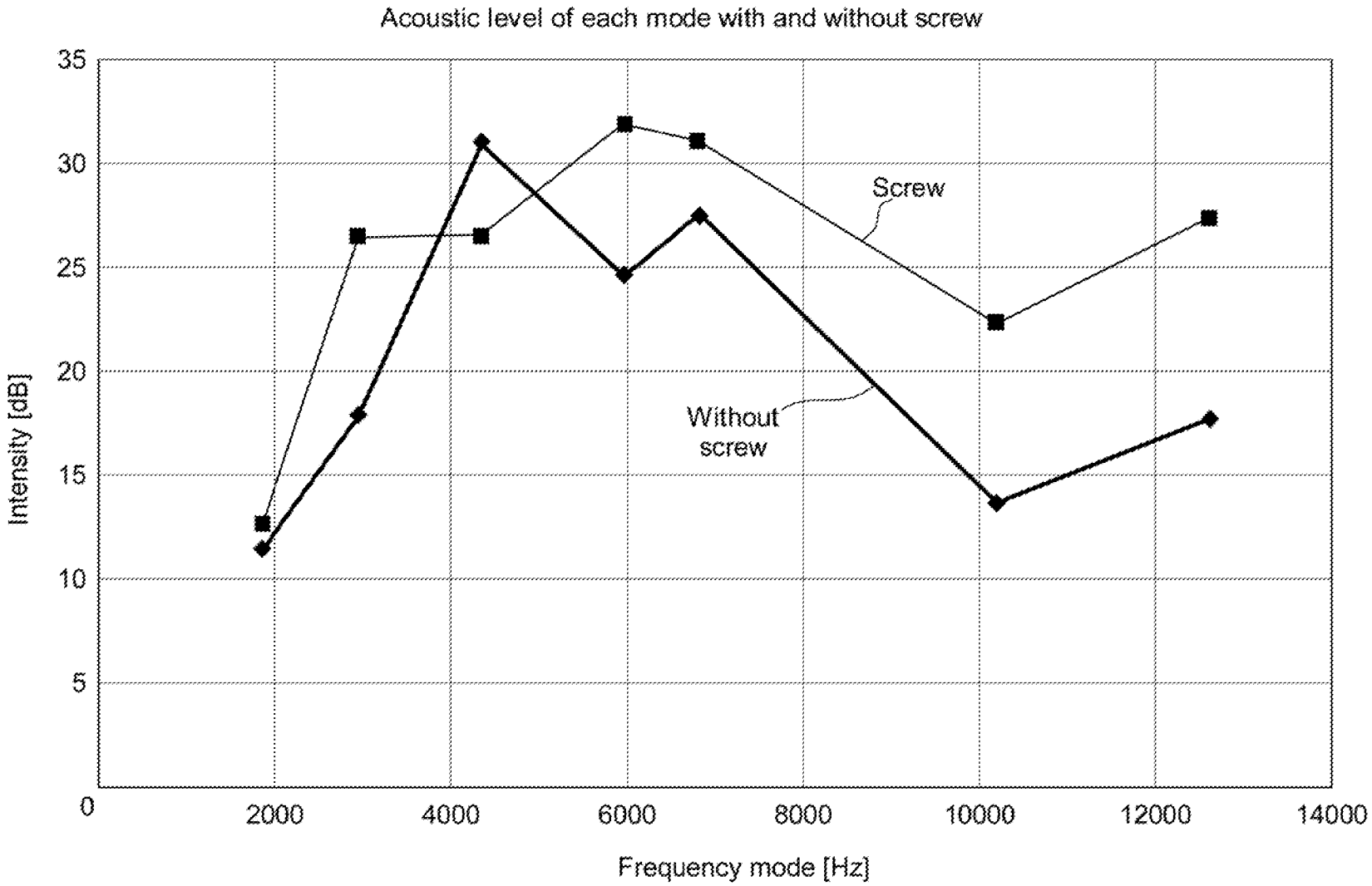
FIG. 5 shows a graph of the acoustic level of each vibration transmission mode of the membrane of the arrangement, held in the watch case with and without fastening screws or constraint according to the invention and with reference to FIGS. 1*a* and 1*b*.

FIG. 5 shows the influence of the use of such a screw 12 on the acoustic level of each acoustic radiation mode in relation to a standard assembly without screws. The graph in FIG. 5 therefore shows the acoustic level of each radiated mode with and without screw (connection part). Various measurement points are shown between 0 and 14 kHz (X axis) and with the values mentioned in the table below, where the abbreviation Lq (level equivalent) defines the acoustic level in decibels dB (Y axis). Generally, the acoustic radiation intensity is much better with the screw bearing against the peripheral rim of the membrane or against the edge element, than without the use of the screw. Normally, a better result may also be envisaged if a plurality of screws are provided in order to hold the membrane in the watch case.

| mode [Hz] | Lq without screw [dB] | Lq with screw [dB] |
|---|---|---|
| 1,850 | 11.43 | 12.59 |
| 2,955 | 17.85 | 26.46 |
| 4,345 | 30.96 | 26.5 |
| 5,979 | 24.61 | 31.9 |
| 6,815 | 27.59 | 31.09 |
| 10,200 | 13.64 | 22.21 |
| 12,620 | 17.65 | 27.34 |

Figure 2A:
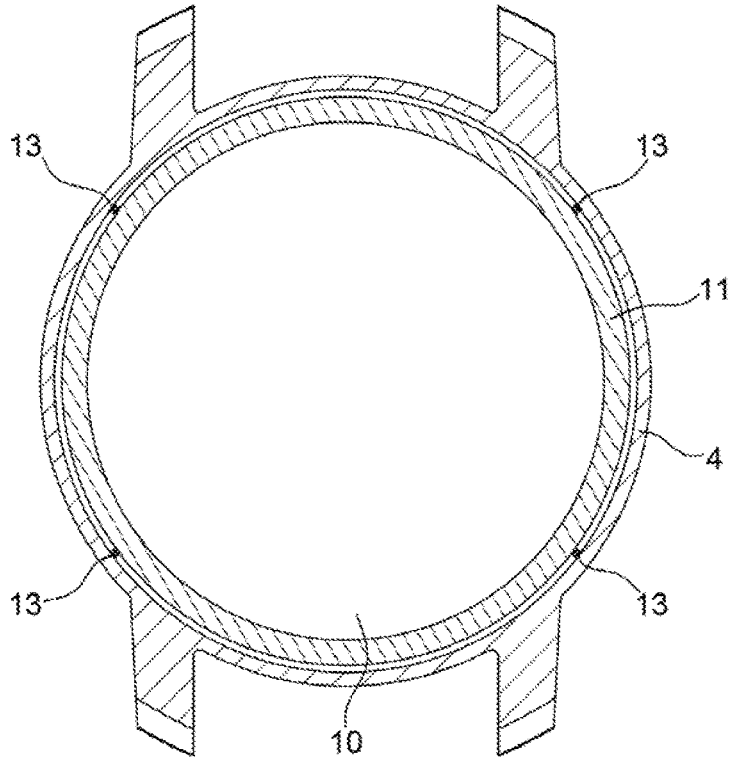
FIGS. 2*a* and 2*b* show in a simplified manner a top view of a second embodiment of an arrangement for the holding and vibration transmission of an acoustic radiating membrane, and a partial cross-section of a second embodiment of the arrangement for the holding and vibration transmission of an acoustic radiating membrane in a watch case according to the invention.
Figure 2B:
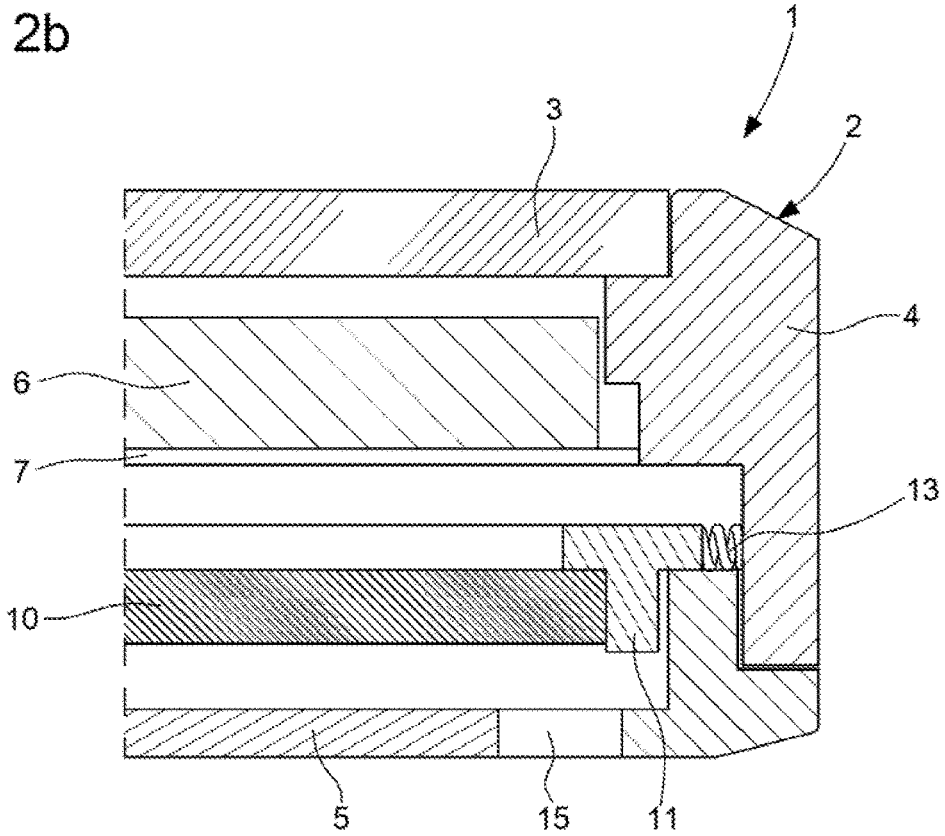

FIGS. 2*a* and 2*b* show a simplified top view without horological movement 6 and support 7 of the horological movement, and a simplified partial cross-section of a second embodiment of a watch case 2 comprising an arrangement for the holding and vibration transmission of at least one acoustic radiating membrane 10. The only difference of this second embodiment in relation to the first embodiment relates to the arrangement for holding the acoustic radiating membrane 10, which is held in the watch case 2 by at least one connection part 13. Said connection part 13 is a coil spring bearing between a cylindrical surface of the rim of the membrane or of the edge element 11 and an inner portion of the watch case 2, which is preferably the middle 4.

As previously, if a single compressed coil spring 13 is used for the holding and the vibration transmission of the acoustic membrane 10, the peripheral rim of the membrane 10 or the edge element 11 of the membrane 10 comes to bear against a cylinder-shaped inner surface for example of the middle 4 opposite the coil spring 13.

However, it may preferably be provided to have a plurality of coil springs 13 for holding the membrane 10 or the membrane 10 with the edge element 11 thereof. At least two coil springs 13 at 180° from one another or three coil springs 13 at 120° from one another or four coil springs 13 at 90° from one another as shown in FIGS. 2*a* and 2*b*, or even more coil springs 13 may be provided.

It should be noted that with such an arrangement for the holding and vibration transmission of an acoustic radiating membrane 10 in the watch case 2, there can be no adaptation of a frequency of acoustic radiation of the membrane 10 in tune with a struck gong generating a particular note or with at least one activated blade of a musical pin-barrel.

Figure 3:
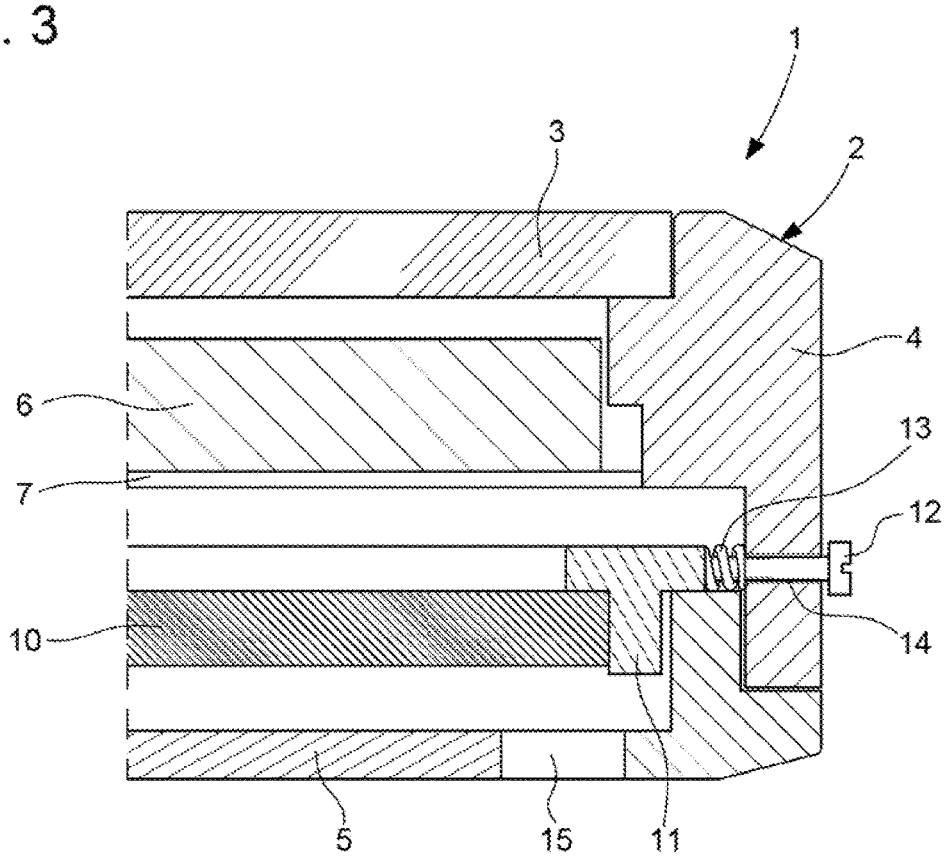
FIG. 3 shows in a simplified manner a partial cross-section of a third embodiment of an arrangement for the holding and vibration transmission of an acoustic radiating membrane in a watch case according to the invention.

FIG. 3 shows a partial cross-section of a third embodiment of an arrangement for the holding and vibration transmission of an acoustic radiating membrane 10 in a watch 1 case 2. This third embodiment differs from the previous two embodiments only due to the fact that the holding of the acoustic radiating membrane is obtained by a combination or an assembly of a first connection part 12 and of a second connection part 13. The first connection part 12 is a screw, which may be screwed into a threaded opening 14 of a portion of the watch case 2, which is for example the middle 4 as described with reference to FIGS. 1*a* and 1*b* of the first embodiment. The second connection part 13 is a coil spring, which is passed through by the shaft of the screw 12. The coil spring 13 comes to bear between a cylindrical surface of the rim of the membrane 10 or of the edge element 11 and an inner portion of the watch case 2.

As described previously for the first and second embodiments, a plurality of screw 12 and coil spring 13 assemblies may be provided regularly distributed around the membrane 10 or the edge element 11 of the membrane 10. At least two screw 12 and coil spring 13 assemblies at 180° from one another or three screw 12 and coil spring 13 assemblies at 120° from one another or four screw 12 and coil spring 13 assemblies at 90° from one another, or even more screw 12 and coil spring 13 assemblies may be provided.

Figure 4:
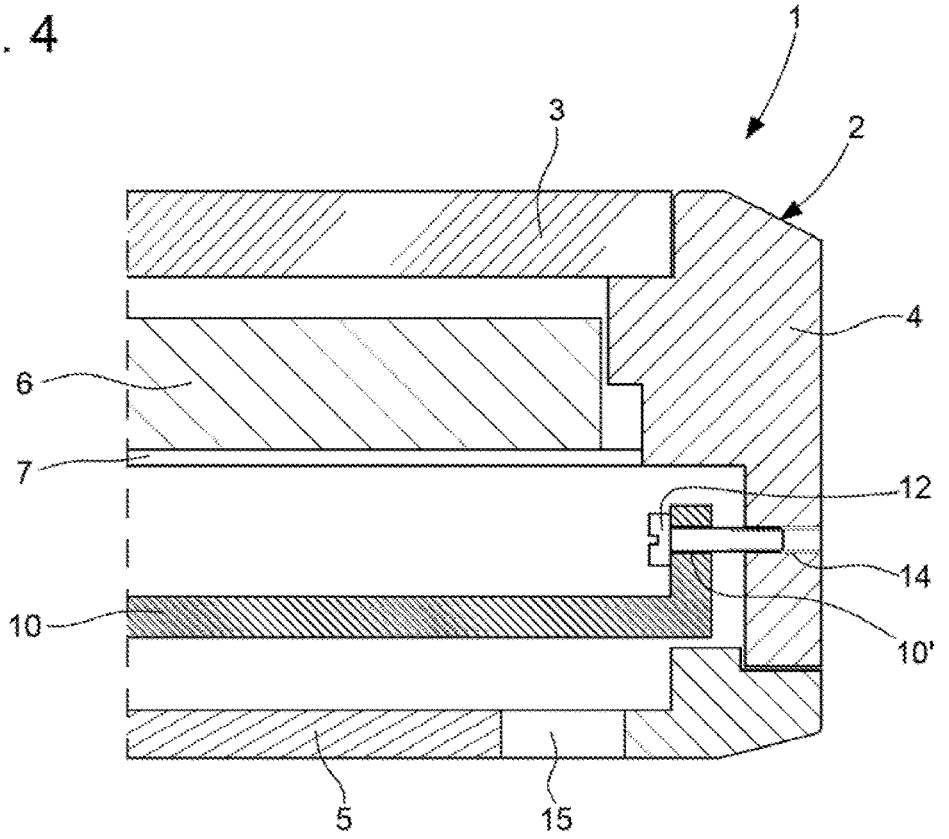
FIG. 4 shows in a simplified manner a partial cross-section of a fourth embodiment of an arrangement for the holding and vibration transmission of an acoustic radiating membrane in a watch case according to the invention.

FIG. 4 shows a partial cross-section of a fourth embodiment of an arrangement for the holding and vibration transmission of an acoustic radiating membrane 10 in a watch 1 case 2. In this fourth embodiment, the acoustic radiating membrane 10 is shown not connected to an edge element, but has a dome shape with a peripheral edge rising from a dome base of the membrane 10.

An opening 10' is produced in the peripheral edge for the passage of a connection part 12, which is preferably a screw 12 in order to screw same into a threaded opening 14 of a portion of the watch case, such as the middle 4 for example. The screw head 12 is located on the inner side of the edge of the dome of the membrane. In this fourth embodiment of the arrangement for the holding and vibration transmission of the acoustic radiating membrane 10 in the watch case 2, it is necessary to provide at least two screws 12 for holding the membrane 10 in the watch case 2. A first screw 12 passing through a first opening 10' of the membrane 10 edge is screwed into a first threaded opening 14 for example in the watch case 2 middle 4, and a second screw 12 passing through a second opening 10' of the membrane 10 edge for example at 180° from the first opening 10' is screwed into a second threaded opening 14 for example in the watch case 2 middle 4 and away from the first threaded opening 14. The two threaded openings 14 for the two screws 12 are therefore in this case at 180° from one another. Three screws 12 may also be provided each passing through a respective opening 10' in the peripheral edge of the membrane 10 in order to each be screwed into a respective threaded opening 14 for example in the middle 4. Said threaded openings 14 are preferably spaced 120° apart from one another. For four screws 12 each passing through a respective opening 10' in the peripheral edge of the membrane 10 in order to each be screwed into a respective threaded opening 14 for example in the middle 4, same are spaced 90° apart from one another, and so on and so forth for more than four screws to be screwed into respective threaded openings 14 of the middle 4.

The acoustic radiating membrane is no longer compressed in said fourth embodiment of the holding arrangement, but stretched, which reverses the adaptation of frequency of acoustic radiation in relation to the first and third embodiments. However, this also makes it possible to have an adaptation of frequency of acoustic radiation of the membrane 10 more easily in order to adapt to the vibration frequency of at least one gong once struck by a hammer.

It should also be noted that the material of the acoustic membrane 10 may also be precious or noble wood, such as mahogany or oak or yellow birch, which is known for the excellent acoustic radiation properties thereof. Spruce or maple or rose wood or kingwood or cherry wood or ebony generally used for the designing of violins or guitars may be also be chosen. Other woods may also be chosen, such as poplar, willow, walnut, fir and even certain fruit trees. However, for a good holding in the watch case, the membrane 10 may also be produced in a material such as steel, or gold or platinum or amorphous metal, or a polymer, or in another metal material.

From the description that has just been given, a plurality of alternative embodiments of the arrangement for the holding and vibration transmission of the acoustic radiating membrane in the watch case may be devised by the person skilled in the art without departing from the scope of the invention defined by the claims. At least one connection part may be disposed close to a gong carrier fastened to the middle.

The invention claimed is:

1. An arrangement for a holding and vibration transmission of an acoustic vibrating membrane (10) in a musical or striking watch case (2), the case (2) comprising at least one crystal (3) mounted on a first side of a middle (4) and a back (5) mounted on a second side of the middle (4) opposite the first side, the crystal and the back extending parallel to a plane of the watch, wherein the acoustic radiating membrane (10) is held in a portion of the watch case (2) by at least one connection part (12, 13) disposed between a peripheral rim of the membrane (10) or an edge element (11) of the membrane (10) and a portion of the watch case (2) by a holding force acting in a direction parallel to the plane of the watch.

2. The arrangement according to claim 1, wherein the connection part is at least one screw (12) screwed through a threaded opening (14) of a portion of watch case (2) in a radial direction the watch case, an inner end of the screw coming to bear against a peripheral rim of the membrane (10) or against an outer portion of the edge element (11) fastened on a periphery of the membrane (10).

3. The arrangement according to claim 1, wherein a plurality of connection parts for holding the acoustic radiating membrane (10) are screws (12), and wherein the screws (12) are arranged to each come into contact with the peripheral rim of the membrane (10) or with the edge element (11) of the membrane once each screwed through a respective threaded opening (14) of a portion of watch case (2), the threaded openings (14) being regularly distributed around the membrane (10) or the edge element (11) of the membrane.

4. The arrangement according to claim 3, wherein the screws (12) are two in number disposed at 180° from one another or three in number disposed at 120° from one another or four in number disposed at 90° from one another.

5. The arrangement according to claim 2, wherein the portion of watch case (2), which comprises the threaded opening or openings (14), is the middle (4) of the watch case (2).

6. The arrangement according to claim 1, wherein the connection part is a coil spring (13) disposed between a portion of the watch case (2) and a peripheral rim of the membrane (10) or the edge element (11) of the membrane (10).

7. The arrangement according to claim 1, wherein a plurality of connection parts for holding the acoustic radiating membrane (10) are coil springs (13) disposed between a portion of the watch case (2) and the peripheral rim of the membrane (10) or the edge element (11) of the membrane (10), and by being regularly spaced apart from one another on the periphery of the membrane (10) or of the edge element (11) of the membrane (10).

8. The arrangement according to claim 7, wherein the portion of the watch case (2) is the middle (4).

9. The arrangement according to claim 1, wherein the acoustic radiating membrane (10) is obtained by an assembly of a first connection part (12), which is a screw, and of a second connection part (13), which is a coil spring, wherein the screw (12) is screwed into a threaded opening (14) of a portion of the watch case 2, wherein the coil spring (13) is disposed between a portion of the watch case (2) and a peripheral rim of the membrane (10) or the edge element (11) of the membrane (10), and passed through by the shaft of the screw (12).

10. The arrangement according to claim 9, wherein holding the acoustic radiating membrane (10) is obtained by a plurality of screw (12) and coil spring (13) assemblies regularly spaced around the membrane (10) or the edge element (11) of the membrane (10), each screw (12) being screwed into a respective threaded opening (14) of the portion of the watch case (2), which is the middle (4).

11. The arrangement according to claim 1, wherein the acoustic radiating membrane (10) has a dome shape with a peripheral edge rising from a dome base of the membrane (10), wherein at least two connection parts, which are screws (12) are provided each passing through a respective opening (10') produced in the peripheral edge of the membrane (10) in order to each be screwed into a respective threaded opening (14) of a portion of the watch case (2), a head of each screw (12) being located on a inner side of the edge of the dome of the membrane (10), the screws being regularly spaced apart from one another.

12. A striking or musical watch (1), which comprises an arrangement of acoustic radiating membrane in a watch case according to claim 1.

13. The striking or musical watch (1) according to claim 12, wherein the striking mechanism comprises at least one gong mounted on a gong carrier and to be struck by a hammer for the generation of a particular note, the acoustic radiating membrane (10) being compressed or stretched by a connection part, in order to adapt a frequency of acoustic radiation of the membrane in tune with the note generated by the gong in vibration.

* * * * *